US006773241B2

(12) United States Patent
Suzuki et al.

(10) Patent No.: US 6,773,241 B2
(45) Date of Patent: Aug. 10, 2004

(54) PUMP UNIT

(75) Inventors: Masakazu Suzuki, Sashima-gun (JP); Hironobu Oki, Sashima-gun (JP)

(73) Assignee: Kyosan Denki Co., Ltd., Sashima-gun (JP)

( * ) Notice: Subject to any disclaimer, the term of this patent is extended or adjusted under 35 U.S.C. 154(b) by 79 days.

(21) Appl. No.: 10/103,890

(22) Filed: Mar. 25, 2002

(65) Prior Publication Data

US 2002/0141887 A1 Oct. 3, 2002

(30) Foreign Application Priority Data

Mar. 30, 2001 (JP) ..... 2001-100938

(51) Int. Cl.[7] ..... F02M 37/10
(52) U.S. Cl. ..... 417/423.3; 123/509
(58) Field of Search ..... 417/360, 423.3, 417/423.9, 423.15; 123/509; 137/565.17

(56) References Cited

U.S. PATENT DOCUMENTS 5,758,627 A * 6/1998 Minagawa et al. ..... 123/509
5,769,061 A * 6/1998 Nagata et al. ..... 123/509
6,123,521 A * 9/2000 Mori et al. ..... 417/423.3
6,267,103 B1 * 7/2001 Ludwig et al. ..... 123/509
6,378,504 B1 * 4/2002 Horiuchi et al. ..... 123/509

FOREIGN PATENT DOCUMENTS

JP A 2000-18113 1/2000

* cited by examiner

*Primary Examiner*—Michael Koczo
(74) *Attorney, Agent, or Firm*—Oliff & Berridge, PLC

(57) ABSTRACT

The intermediate part is fixed between the unit case body, which integrally houses the fuel pump and the filter element, and the unit case supporting flange, which hangs the pump unit from the upper wall of the fuel tank. A height Ha of the intermediate part is set to correspond to a height difference between a height Ht of the fuel tank and the sum of a height Hb of the unit case body and a height Hc of the unit case supporting flange. The wall is arranged in the proximity of the lower end of the intermediate part to make a fuel channel formed below the wall small and avoid generation of air stagnation in the fuel channel.

10 Claims, 5 Drawing Sheets

PUMP UNIT

The disclosure of Japanese Patent Application No. 2001-100938 filed on Mar. 30, 2001 including the specification, drawings and abstract is incorporated herein by reference in its entirety.

BACKGROUND OF THE INVENTION

1. Field of Invention

The present invention relates to a pump unit in which a unit case, which houses a fuel pump, is hung from an upper wall of a tank by a unit case supporting flange. Especially, the present invention relates to a pump unit equipped with a height adjusting part to install fuel tanks with different heights.

2. Description of Related Art

As for a fuel pump which supplies fuel to an engine, an in-tank fuel pump, which is installed in a fuel tank, is widely used these days. Furthermore, parts surrounding the tank are integrated to reduce vehicle cost, and so on. As a result, a filter element, which filters fuel discharged from a fuel pump, is combined with the fuel pump. And the filter element and the fuel pump form a pump unit. Then the pump unit is hung from an opening on an upper wall of the fuel tank.

FIG. 3 shows an example of installing the above-described pump unit in a fuel tank. A pump unit 30 according to FIG. 3 includes a unit case body 35, a pump 32 (described later), and a filter element 33. A unit case supporting flange 34 is connected with the unit case body 35 by means of weld, and so on. The connected two parts form a unit case 31. An engaging claw 37 of an engaging part 36, which extends downward from the unit case 35, is engaged with an engaging hole 41 of a pump holder 40 which supports the lower end of the pump 32. As a result, the pump holder 40 is supported by the unit case body 35. A flange part 38 of the unit case supporting flange 34 is hung and fixed on an upper wall 39 of the fuel tank. As a result, the unit case supporting flange 34 supports the entire pump unit 30.

A filter housing part 42 is located on the side of the unit case body 35. The filter element 33 is housed and fixed in the filter housing part 42. A pump connection 43 is provided in the proximity of the filter housing part 42 and fits into an outlet 45 of the pump 32 through a grommet 44. An opening 46 of the pump connection 43 is connected with an upper-end opening 47 of the filter element 33, which is housed in the filter housing part 42, through a connecting space 48. The connecting space 48 is located on the underside of the unit case supporting flange 34.

As described above, the lower end of the pump 32 is placed on the pump holder 40 which is supported by the unit case body 31. The outlet 45, which is located at the upper end of the pump 32, is connected with the pump connection 43 through the grommet 44 and incorporated into the pump unit 30. A suction filter 51 is attached to a suction hole 50 of the pump 32. The suction filter 51 extends along a bottom wall 52 of the fuel tank to suck in fuel in the lowermost part of the fuel tank.

A fuel supplying part 55 is provided at the unit case supporting flange 34. As described above, fuel in the tank is supplied through the suction filter 51, the pump 32, the opening 46, the connecting space 48, and the filter element 33 to an engine from the fuel supplying part 55 after flowing through a channel surrounding the pump 32 (not shown). In the pump unit 30 described above, a height of the entire pump unit 30 needs to correspond to a length from the bottom wall 52 of the fuel tank to the upper wall 39 due to the following two reasons. The first reason is that the pump unit 30 is hung from the upper wall 39 of the fuel tank. The second reason is that the suction hole 50 of the pump 32 needs to be located in the proximity of the bottom wall 52 of the fuel tank to suck in fuel in the fuel tank as much as possible. However, a length from a bottom wall to an upper wall of a fuel tank differs depending on the type of a vehicle. Therefore, a height adjusting means is needed to use the same tank as much as possible and correspond to as many fuel tanks as possible.

To correspond to fuel tanks with different heights, structures shown in FIGS. 4A and 4B, for example, may be adopted. According to the structure shown in FIG. 4A, a pump unit is substantially identical to the pump unit 30 shown in FIG. 3. In this case, the pump unit is manufactured to be installed in the shortest fuel tank in which the pump can be fitted. The shortest tank has a minimum height of H1. When the pump is applied to a taller tank with a height of H2, as shown in FIG. 4B, a joint pipe 55 with a length of L1 (−H2-H1) may be provided between the pump connection 43 and the outlet 45 of the pump 32 to correspond to the height H2.

The joint pipe 55 is connected to the pump connection 43 through the grommet 44 at a unit connection 56 located at the upper end. At a pump connection 57 located at the lower end, the joint pipe 55 is connected to the outlet 45 of the pump 32 through the grommet 58. Therefore, fuel from the outlet 45 can he discharged to the opening 46, located at the pump connection 43 of the unit case body 35, through the joint pipe 55.

According to the structure adopting the joint pipe 55, relative relation regarding positions of the pump 32 and the unit case body 35 deviates vertically. As a result, the pump 32 moves relatively downward and the pump holder 40, which supports the lower end of the pump 32, also moves downward. Therefore, a housing 59 needs to be provided between the pump holder 40 and the engaging part 36 located below the unit case body 35. Regarding the housing 59, the engaging hole 61, which is provided at a unit connection 60 located at the upper end, is engaged with the engaging claw 37 of the engaging part 36. An engaging hole 63, which is provided at a holder connection 62 located at the lower end, is engaged with the engaging hole 41 of the pump holder 40. As a result, the pump holder 40 is fixed on the unit case body 35 through the housing 59, and the housing 59 supports the lower end of the pump 32. Therefore, a length of the joint pipe 55 is set to L1 which is equal to that of the housing 56.

According to the structure adopting the joint pipe 55 for adjusting height, the joint pipe 55, the grommet 58, and further, the housing 59 are needed. Therefore, it is inevitable that manufacturing cost for each component and assembly man-hour will increase. As a result, the end product becomes expensive.

Also, it is conceivable that a length of each part can be adjusted, as shown in FIGS. 5A and 5B, for example, to correspond to fuel tanks with different heights. In other words, like FIG. 3 and FIG. 4A, FIG. 5A shows the pump unit 30 which is manufactured to be installed in the shortest fuel tank in which the pump can be fitted. FIG. 5B shows, for example, when a height of a tank is changed from H1 to H2. It is conceivable that a length of the unit case supporting flange 34 be lengthened by L1 to correspond to the changed height. Furthermore, as shown in FIG. 5C, for example, when a height of a tank is changed from H1 to H3, it is conceivable that a length of the unit case supporting flange 34 be lengthened by L1 like the example of 5B and a length of the upper part of the unit case body 35 be lengthened by L2. According to the example shown in FIG. 5C, the joint pipe 55 is adopted like the example of 4B and lengthened by L3 to correspond to a tank with a height of H3. The example in FIG. 5C includes all the above-mentioned height adjusting means.

As described above, when the unit case supporting flange 34 or the unit case body 35 needs to be lengthened to correspond to fuel tanks with different heights, a volume of the connecting space 48, which is located between the opening 46 connected to the outlet 45 of the pump and the upper-end opening 47 of the filter element 33, increases in proportion to the lengths L1 shown in FIG. 5B and L2 shown in FIG. 5C. When fuel flows into the connecting space 48 from the outlet 45, the flow of the fuel slows down and then stagnates. As a result, gaseous components of the fuel collect gradually and turn into bubbles. Furthermore, a large gaseous space, which is so-called air stagnation, is formed in the upper part of the connecting space 48.

When the above-mentioned air stagnation is generated, the air stagnation eventually generates resistance to fuel flow, which exerts a negative effect on discharge performance of the pump 32 and contributes to engine failure such as knocking. Furthermore, when a length of the unit case supporting flange 34 and that of the unit case body 35 need to be changed, it largely increases the manufacturing cost of the end product due to the unfavorable following two reasons.

The first reason is that a mold of a component with a complicated shape such as the unit case body 35 can be expensive. The second reason is that, as described above, different molds are needed depending on a length of a component.

SUMMARY OF THE INVENTION

Therefore, it is an object of the present invention to provide a pump unit with the following two features. The first feature is that the number of added components to correspond to fuel tanks with different heights is minimized. The second feature is height adjustment can be carried out without generating air stagnation in a fuel channel in a unit case.

According to a first aspect of the present invention, a pump unit is provided with a unit case body which houses the pump, a unit case supporting flange which supports the unit case body and hangs the pump unit from a fuel tank, and a wall which is provided at an intermediate part and has the following two functions.

The first function is to fix the intermediate part, which adjusts a height of the pump unit, between the unit case body and the unit case supporting flange. The second function is to cover a fuel channel having an open upper portion, provided above the unit case body.

According to the first aspect, height adjustment of the unit case body and the unit case supporting flange are not necessary. Therefore, height adjustment can be carried out with inexpensive means and no difficulties. And it is not necessary to use many components such as a joint pipe and a housing, and so on. Therefore, the number of components can be decreased. An end product can be less expensive since both assembly time and component management can be decreased.

Furthermore, the fuel channel, which is covered by the wall provided at the intermediate part, can be made sufficiently small so that generation of air stagnation in the fuel channel can be prevented.

DETAILED DESCRIPTION OF PREFERRED EMBODIMENTS

Figure 1:
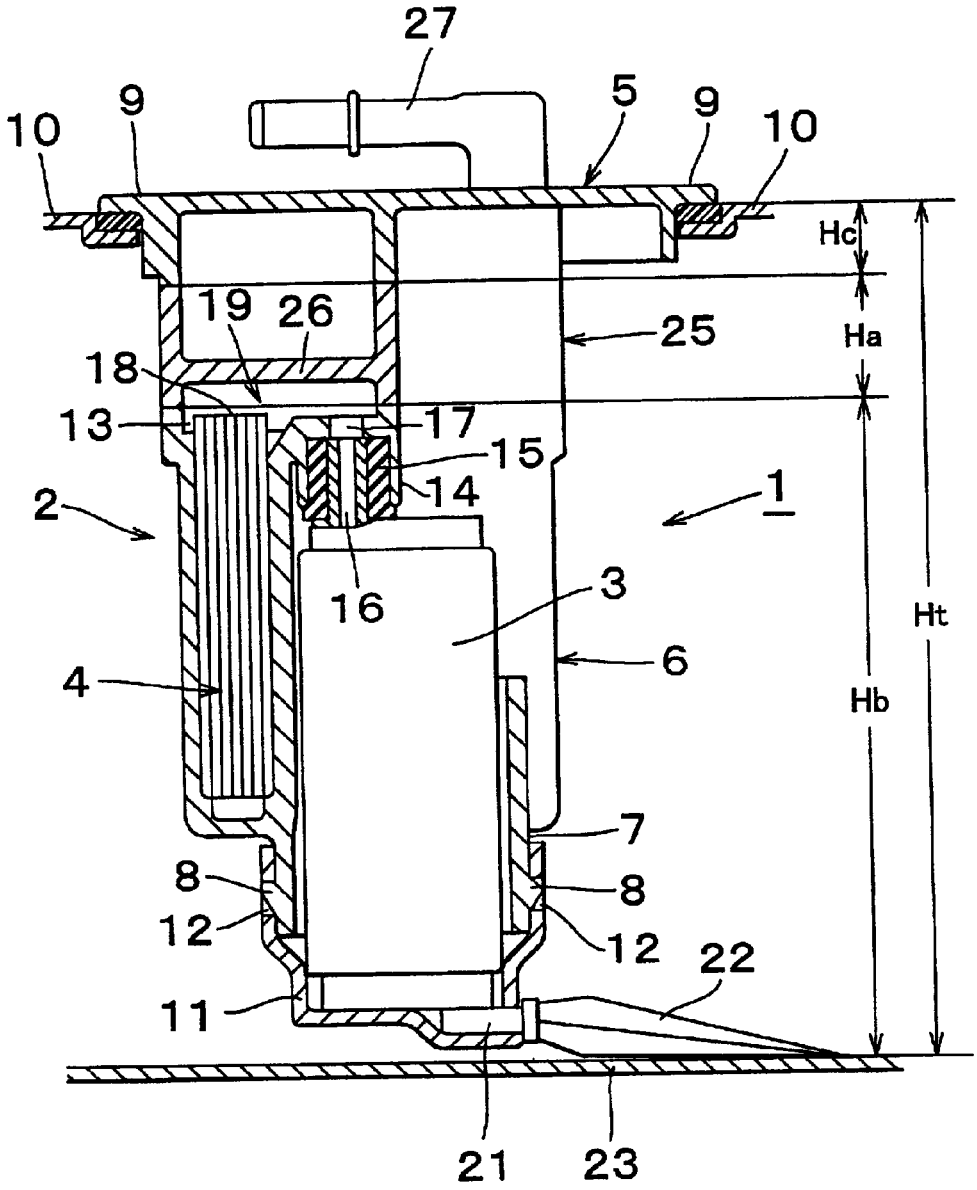
FIG. 1 is a cross-sectional view of a pump unit provided with an intermediate part according to a preferred embodiment of the present invention.
Figure 3:
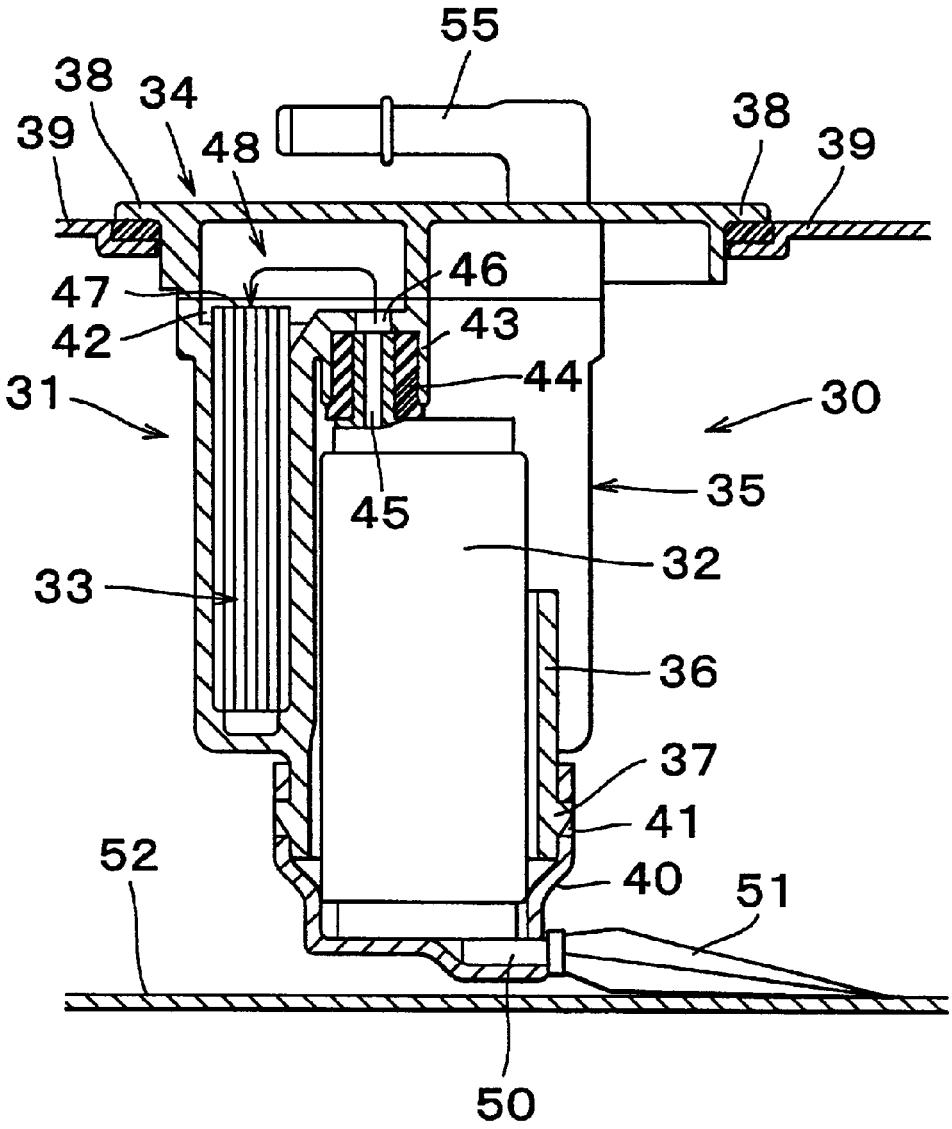
FIG. 3 Related Art
FIG. 3 is a cross-sectional view which shows components of the pump unit without the intermediate part.
Figure 4B:
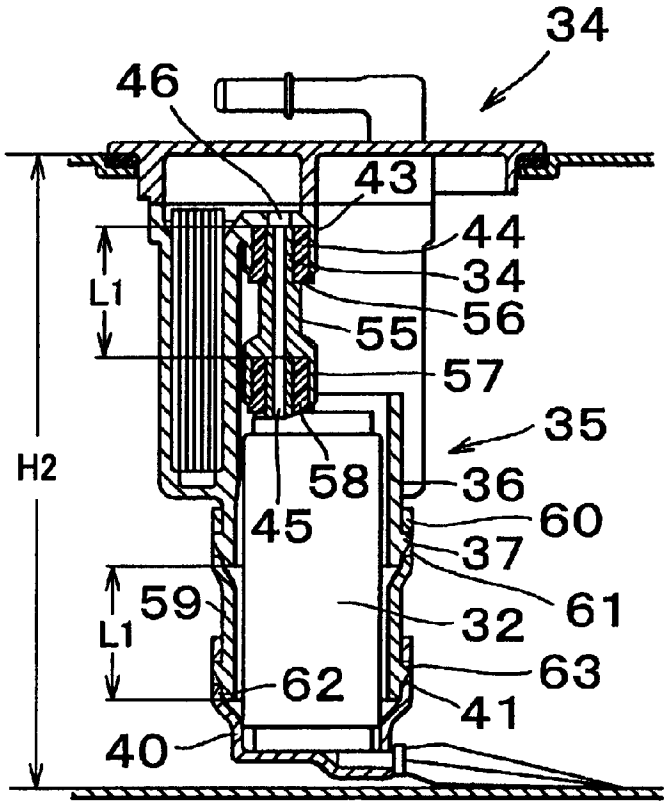
FIG. 4B Related Art
FIG. 4B is a cross-sectional view which shows an example of a pump unit with a joint pipe, and so on to apply to a tank with a height of H2 according to the related art of the present invention.
Figure 4A:
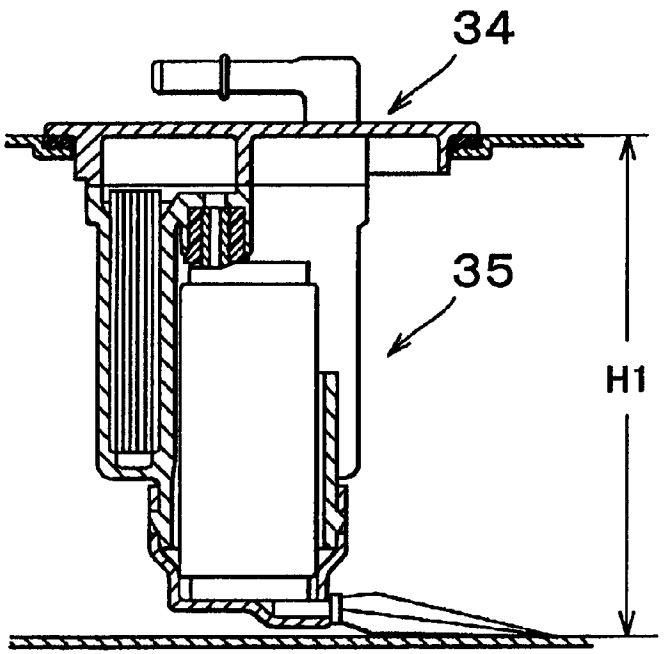
FIG. 4A Related Art
FIG. 4A is a cross-sectional view which shows an example of a pump unit to apply to a tank with a height of H1 according to the related art of the present invention.
Figures 5A, 5B, 5C:
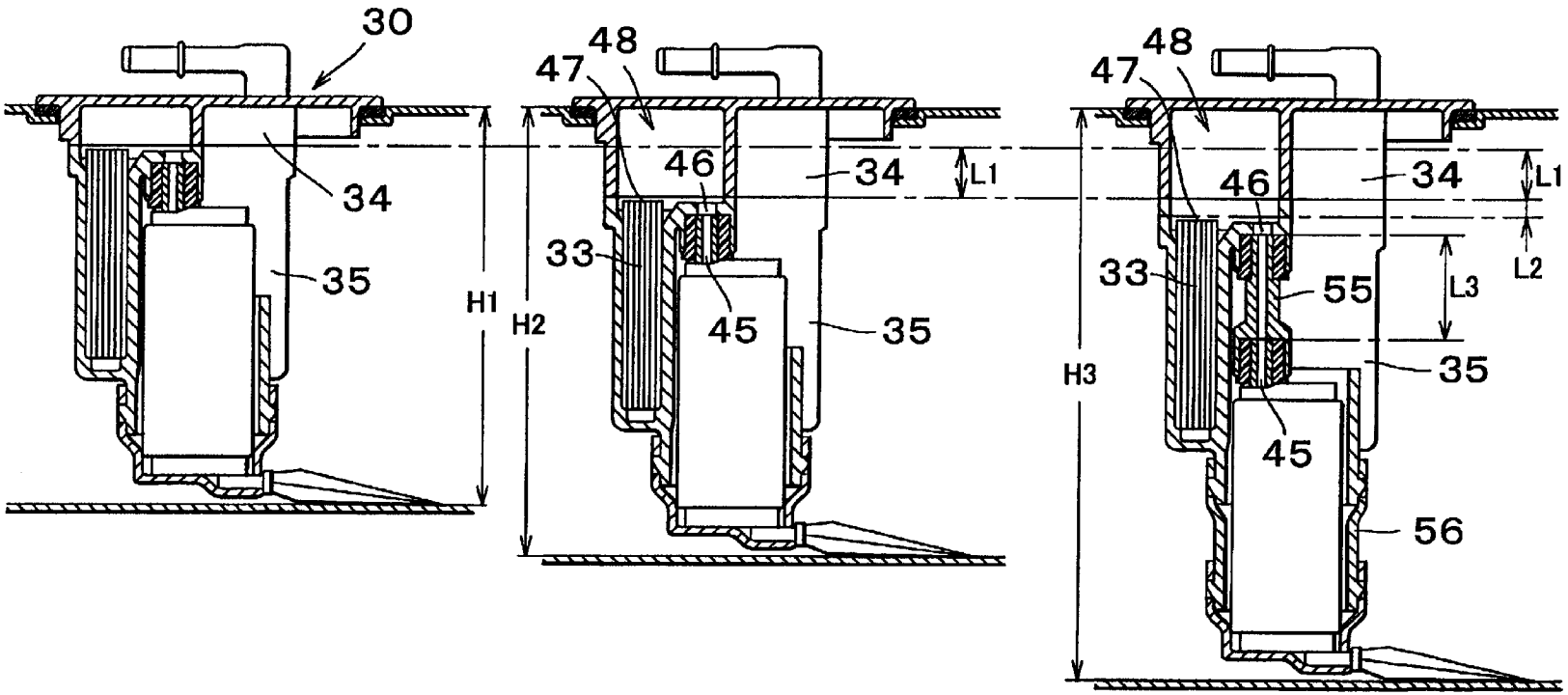
FIG. 5A Related Art
FIG. 5B Related Art
FIG. 5C Related Art
FIG. 5A is a cross-sectional view which shows an example of a pump unit to apply to tank with a height of H1 according to the related art of the present invention.
FIG. 5B is a cross-sectional view which shows an example of a pump unit with an extended unit case supporting flange to apply to a tank with a height of H2 according to the related art of the present invention.
FIG. 5C is a cross-sectional view which shows an example of a pump unit with a further extended unit case body and a joint pipe, and so on to apply to a tank with a height of H3 according to the related art of the present invention.

The following explains the preferred embodiment according to the attached drawings. FIG. 1 shows a pump unit 1 which integrally houses a fuel pump and a filter element according to the present invention and is hung from a fuel tank. FIG. 1 especially shows an example of the pump unit 1 applying a unit case 2 with substantially the same components with the ones of a unit case according to the related art in FIG. 3 to install the pump unit 1 in a fuel tank with a height of Ht. The unit pump 1 is different from the one shown in FIG. 3 by having an intermediate part 25.

Figure 2:
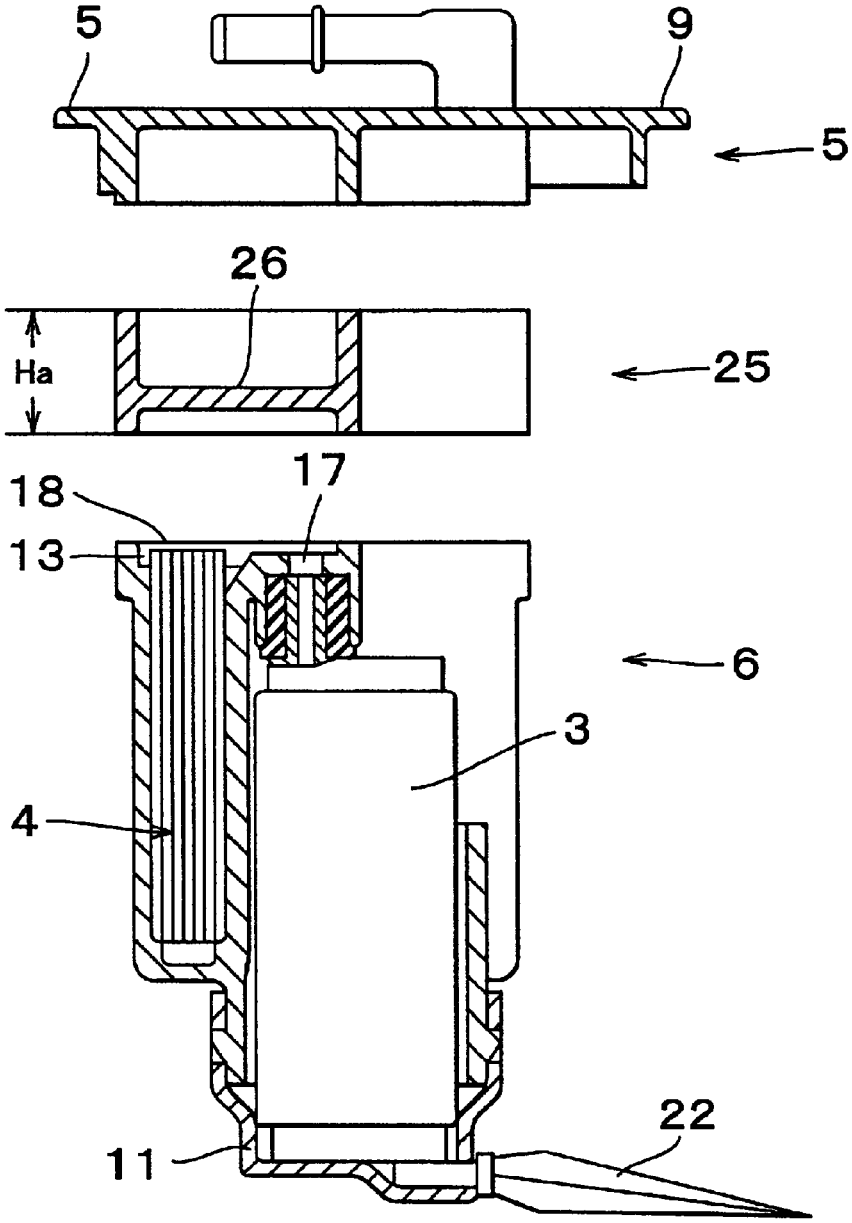
FIG. 2 is a cross-sectional view which shows an exploded condition of the main components of the pump unit according to the preferred embodiment.

As shown in the exploded view of the pump unit 1 in FIG. 2, the pump unit 1 includes the intermediate part 25 fixed on top of a unit case body 6 which houses a pump 3 and a filter element 4. The intermediate part 25 is fixed by means of hot-plate welding. Furthermore, a unit case supporting flange 5 is fixed on top of the intermediate part 25. Regarding connection of each above-mentioned part, although fixation can be done by other means such as cement, and so on, hot-plate welding is the most favorable because of good sealing capacity of each part and easy connection.

As shown in FIG. 1, an engaging claw 8 of an engaging part 7, which extends downward from a unit case body 6, is engaged with an engaging hole 12 of a pump holder 11 which supports the lower end of a pump 3. As a result, the pump holder 11 is supported by the unit case body 6. A flange part 9 of a unit case supporting flange 5 is fixed and hung from an upper wall 10 of the fuel tank. As a result, the flange part 5 fixes the entire pump unit 1 to the fuel tank.

A filter housing part 13 is located on the side of the unit case body 6, and a filter element 4 is housed and fixed in the filter housing part 13. A pump connection 14 is provided in the proximity of the filter housing part 13 and fits into an outlet 16 of the pump 3 through a grommet 15. An opening 17 of the pump connection 14 is connected with an upper-end opening 18 of the filter element 4 through a connecting space 19 (mentioned later). The connecting space 19 is located on the underside of a bottom wall 26 of the intermediate part 25.

As described above, the lower end of the pump 3 is placed on the pump holder 11 which is supported by the unit case body 6. The outlet 16, which is located at the upper end of the pump 3, is connected with the pump connection 14 through the grommet 15 and incorporated into the pump unit 1. A suction filter 22 is attached to a suction hole 21 of the pump 3. The suction filter 22 extends along a bottom wall 23 of the fuel tank to suck in fuel in the lowermost part of the fuel tank.

A fuel supplying part 27 is provided at the unit case supporting flange 5. As described above, fuel in the tank is supplied through the suction filter 22, the pump 3, the opening 17, the connecting space 19, and the filter element 4 to an engine from the fuel supplying part 6 after flowing through a channel, which is provided at the unit case 2 and surrounding the pump 3 (not shown).

As described above, the unit case body 6 with a height of Hb and the unit case supporting flange 5 with a height of Hc, which are the ones of the main components of the unit case 2 along with the intermediate part 25, are manufactured in the way that the pump 1 fits in the smallest fuel tank among the series of tanks of vehicles with similar fuel supply characteristics. Therefore, like the prior art shown in FIG. 3, the unit case supporting flange 5 is fixed directly on the unit case body 6 without using the intermediate part 25 when the pump unit 1 is applied to the shortest tank with a height Hb+Hc.

On the other hand, the intermediate part 25 with a height of Ha, which is shown in FIG. 1 or FIG. 2, is provided between the unit case body 6 and the unit case supporting flange 5 when the pump 1 is applied to a fuel tank with a height of Ht which is taller than the shortest tank by Ha.

The intermediate part 25 includes a bottom wall 26 which is arranged to be as low as possible within the intermediate part 25 and provided in the proximity of the unit case body 6. Therefore, the bottom wall 26 is arranged in the proximity of the upper end of an opening which is connected to a pump outlet 16 in the unit case body 6. The bottom wall 26 is also arranged as close as possible to the upper-end opening 18 of the filter element 4 which is housed in the filter housing part 13. Furthermore, the bottom wall 26 may be arranged in the way that the cross-sectional area of the connecting space 19 is comparatively small. For example, the cross-sectional area or the connecting space 19 which is formed between the bottom wall 26 and the upper end of the unit case body 6, is smaller than that of a connecting space, which is formed between the unit case body 6 and the unit case supporting flange 5 without using the intermediate part 25. At this point, the bottom wall 26 should be arranged to secure the connecting space 19 not small enough to avoid generating resistance to fluid. Therefore, the bottom wall 26 should not be simply arranged at the lower end of the intermediate part 25.

As described above, a volume of the connecting space 19, which is connected through the outlet 16 of the fuel pump and the upper-end opening 18 of the filter element 4, can be sufficiently decreased since the bottom wall 26 of the intermediate part 25 is arranged in the proximity of the lower end of the intermediate part 25. A sufficient flow rate of the fuel, which is discharged from the pump 3 and sucked into the filter element 4 from the connecting space 19, can be secured. Therefore, generating air stagnation in the connecting space 19 can be avoided with certainty. As a result, increase in resistance to fuel flux, deterioration of discharge performance of the pump, and knocking generation due to the above-mentioned causes, and so on can be avoided.

A height of the intermediate part 25 Ha is set and manufactured according to a height of a tank Ht. According to the above-mentioned preferred embodiment, the bottom wall 26 is arranged as low as possible within the intermediate part 25. However, this is not the only arrangement of the bottom wall 26. The bottom wall 26 can he arranged to secure a sufficiently small volume of the connecting space for the fuel discharged from the pump 3. At this point, a volume should not be too small for avoiding generation of air stagnation. The location of the bottom wall 26 is, as described above, at least at a fuel channel like the connecting space 19 which connects through the outlet 16 of the fuel pump 3 and the upper-end opening 13 of the filter element 4 and is opened by the upper end of the unit case body 6. It is preferable to provide such fuel channel at the entire area or the upper side wall surface formed by the bottom wall 26.

According to the present invention, various embodiments other than the above-described embodiment are possible. For example, various reinforced ribs can be provided at the intermediate part, or the fuel channel can be formed. The present invention also can be applied to various types of fuel pumps, which are hung from a fuel tank, other than the fuel pump with the components described in the above-described embodiment.

What is claimed is:

1. A pump unit comprising:

a unit case body having:

a pump housed within the unit case body, the pump sucking fuel when installed in a fuel tank that houses the pump, the pump having a pump outlet for discharging fuel, a filter element for filtering fuel discharged from the pump outlet, and a connection portion which has an opening that connects the pump outlet and the filter element;

a unit case supporting flange which supports the unit case body and hangs the unit case body in the fuel tank; and an intermediate part having a predetermined height and that is arranged between the unit case body and the unit case supporting flange and is connected to both of the unit case body and the unit case supporting flange to provide a predetermined distance between the unit case body and the unit case supporting flange, the predetermined distance being changed by exchanging the intermediate part having a predetermined height with another intermediate part having a different predetermined height, the intermediate part maintaining the predetermined distance when the intermediate part is arranged between the unit case body and the unit case supporting flange, and covers the opening of the connection portion.

2. The pump unit according to claim 1, wherein:

the connection portion is a channel for supplying the fuel from the pump outlet to the filter element.

3. The pump unit according to claim 1, wherein:

the intermediate part is provided with a wall for covering the opening of the connection portion.

4. The pump unit according to claim 3, wherein:

the wall is provided in the intermediate part such that the connection portion covered by the wall has a predetermined cross-sectional area.

5. The pump unit according to claim 4, wherein:

the predetermined cross-sectional area is a cross-sectional area such that air stagnation is not generated in the connecting portion.

6. The pump unit according to claim 1, wherein:

the intermediate part is fixed between the unit case body and the unit case supporting flange by at least one hot-plate weld.

7. A pump unit comprising:

a unit case body, a pump housed within the unit case body;

a filter element housed within the unit case body;

an intermediate part having a height for increasing the height of the pump unit; and a unit case supporting flange, wherein the intermediate part is placed between the unit case body and the unit case supporting flange and is connected to both of the unit case body and the unit case supporting flange to increase the height of the pump unit by at least the height of the intermediate part.

8. The pump unit according to claim 7, wherein the intermediate part comprises a connection portion wall that is proximate the unit case body to form a connection between the pump and the filter element.

9. The pump unit according to claim 7, wherein the intermediate part has a predetermined height to increase the overall height of the pump unit.

10. The pump unit according to claim 8, wherein the connecting portion wall forms a connection portion to have a predetermined cross-sectional area.

* * * * *